US009868126B2

(12) United States Patent
Dau et al.

(10) Patent No.: US 9,868,126 B2
(45) Date of Patent: Jan. 16, 2018

(54) ELECTROSTATIC SPRAY DEVICE AND METHOD FOR POSITIONING FOR THE SAME

(71) Applicant: SUMITOMO CHEMICAL COMPANY, LIMITED, Tokyo (JP)

(72) Inventors: Van Thanh Dau, Takarazuka (JP); Tibor Terebessy, Wallingford (GB); Jude Anthony Watts, Wallingford (GB)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 349 days.

(21) Appl. No.: 14/380,921

(22) PCT Filed: Feb. 26, 2013

(86) PCT No.: PCT/JP2013/001121
§ 371 (c)(1),
(2) Date: Aug. 25, 2014

(87) PCT Pub. No.: WO2013/128895
PCT Pub. Date: Sep. 6, 2013

(65) Prior Publication Data

US 2015/0021420 A1 Jan. 22, 2015

(30) Foreign Application Priority Data

Feb. 27, 2012 (JP) ..... 2012-040678
Sep. 26, 2012 (JP) ..... 2012-213107

(51) Int. Cl.
*B05B 5/00* (2006.01)
*B05B 5/053* (2006.01)
(Continued)

(52) U.S. Cl.
CPC ..... *B05B 5/0533* (2013.01); *B05B 5/0255* (2013.01); *B05B 5/057* (2013.01); *Y10T 29/494* (2015.01)

(58) Field of Classification Search
CPC ... B05B 5/0533; B05B 5/0535; B05B 5/0255; B05B 5/0536
(Continued)

(56) References Cited

U.S. PATENT DOCUMENTS 4,801,086 A * 1/1989 Noakes ..... B05B 5/0255 239/3
5,188,290 A 2/1993 Gebauer et al.
(Continued)

FOREIGN PATENT DOCUMENTS

JP 2004-530552 A 10/2004
JP 2006-521915 A 9/2006
(Continued)

OTHER PUBLICATIONS

Extended European Search Report issued in corresponding application No. 13754313.8 dated Oct. 5, 2015.
(Continued)

*Primary Examiner* — Arthur O Hall
*Assistant Examiner* — Tuongminh Pham
(74) *Attorney, Agent, or Firm* — Foley & Lardner LLP

(57) ABSTRACT

An electrostatic spray device capable of reducing a leakage current is provided. An electrostatic spray device 100 includes a spray electrode 1 configured to spray a material from an end thereof, a reference electrode 2 for allowing voltage application across the spray electrode 1 and the reference electrode 2, a dielectric 10 on which the spray electrode 1 and the reference electrode 2 are provided, and a gap section 11 provided on a surface of the dielectric 10 for providing on the surface of the dielectric 10 a detouring
(Continued)

current path between the spray electrode 1 and the reference electrode 2.

2 Claims, 10 Drawing Sheets

(51) Int. Cl.
*B05B 5/025* (2006.01)
*B05B 5/057* (2006.01)

(58) Field of Classification Search
USPC ..... 239/690, 3, 704–708
See application file for complete search history.

(56) References Cited

U.S. PATENT DOCUMENTS

| | | | | |
|---|---|---|---|---|
| 5,704,554 | A | 1/1998 | Cooper et al. | |
| 2004/0251326 | A1* | 12/2004 | Pirrie ..... | A61L 9/14 239/690.1 |
| 2008/0283636 | A1 | 11/2008 | Pirrie | |
| 2008/0308095 | A1 | 12/2008 | Trees et al. | |
| 2014/0151471 | A1 | 6/2014 | Dau et al. | |

FOREIGN PATENT DOCUMENTS

| | | | |
|---|---|---|---|
| JP | 2011-083688 | A | 4/2011 |
| WO | WO-2007/077424 | A1 | 7/2007 |

OTHER PUBLICATIONS

Office Action issued in corresponding Chinese Patent Application No. 201380011068.3 dated Dec. 21, 2015.
Office Action issued in corresponding Taiwan application No. 102106204 dated Feb. 15, 2016 with an English translation.
Office Action issued in Japanese Patent Application No. 2012-213107 dated May 31, 2016.
International Search Report issued in International Application No. PCT/JP2013/001121 dated May 28, 2013.
Written Opinion of the International Searching Authority issued in the International Applicaiton No. PCT/JP2013/001121 dated May 28, 2013.
Office Action issued in Chinese Patent Application No. 201380011068.3 dated Jun. 1, 2016.
Office Action issued in Australian Patent Application No. 2013227839 dated Dec. 14, 2016.
Second Office Action issued in Australian Patent Application No. 2013227839 dated Aug. 3, 2017.

* cited by examiner

[Fig. 1]
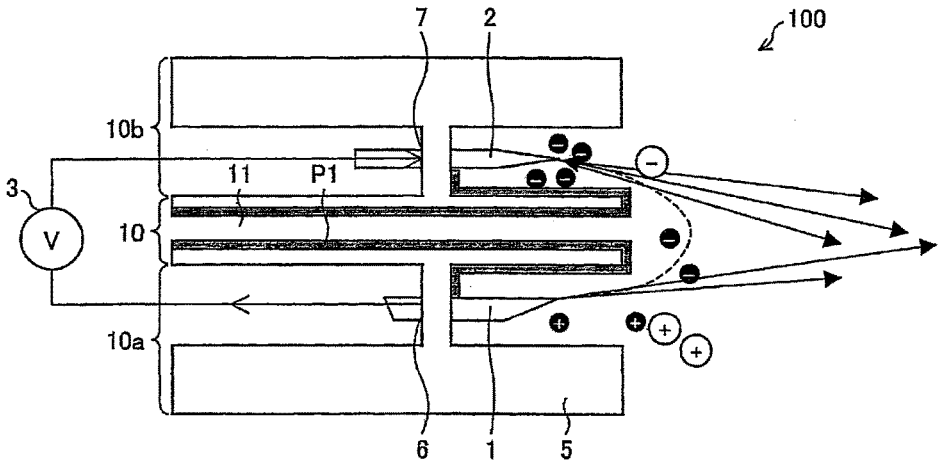
[Fig. 2]
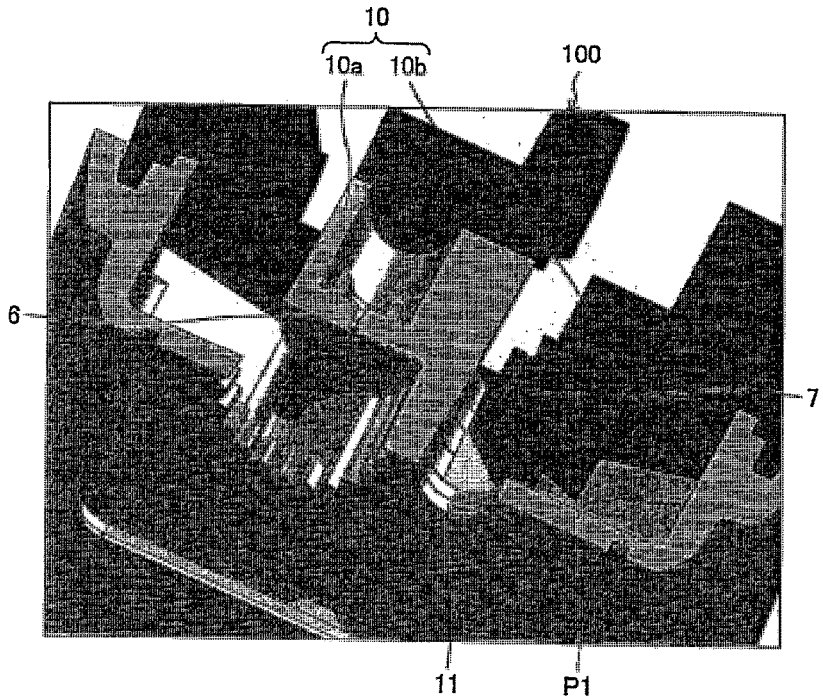

[Fig. 3]
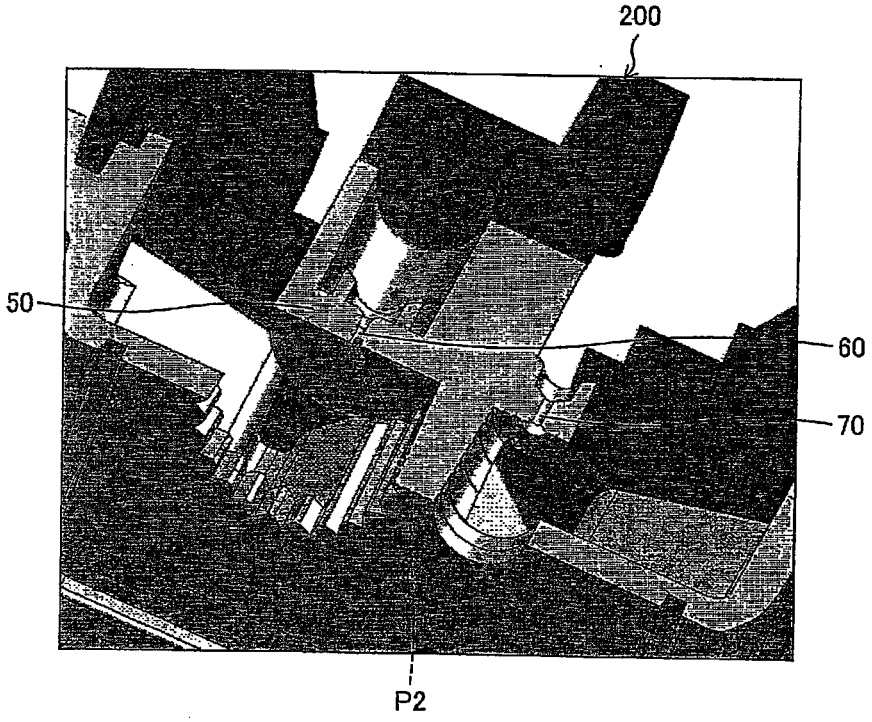
[Fig. 4]
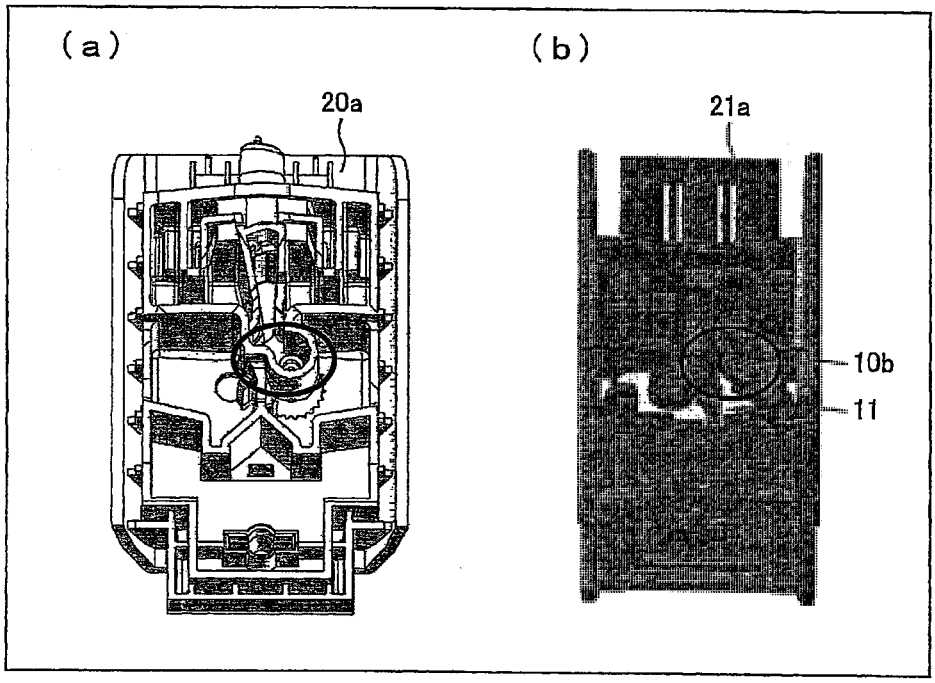

[Fig. 5]
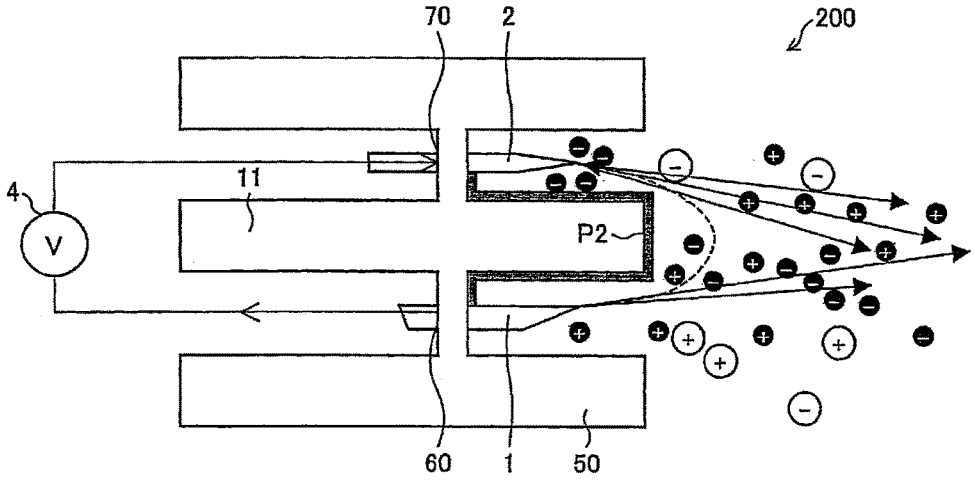
[Fig. 6]
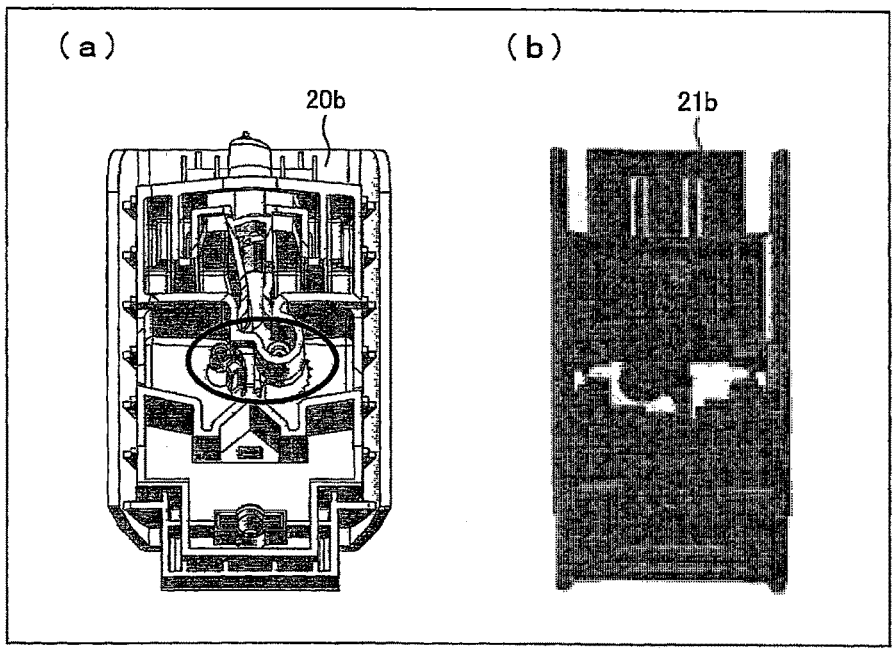

[Fig. 7]
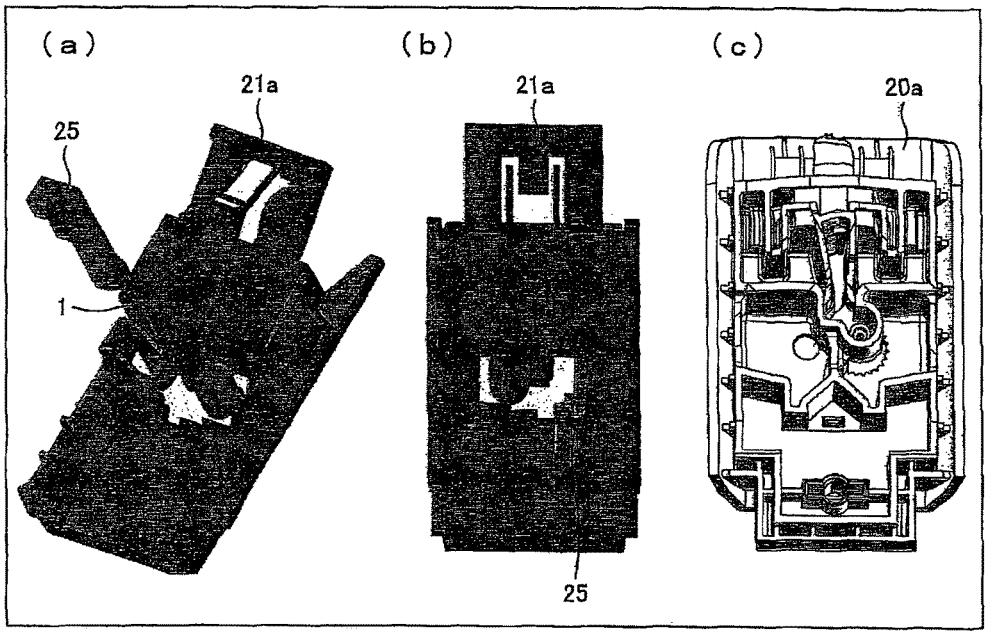
[Fig. 8]
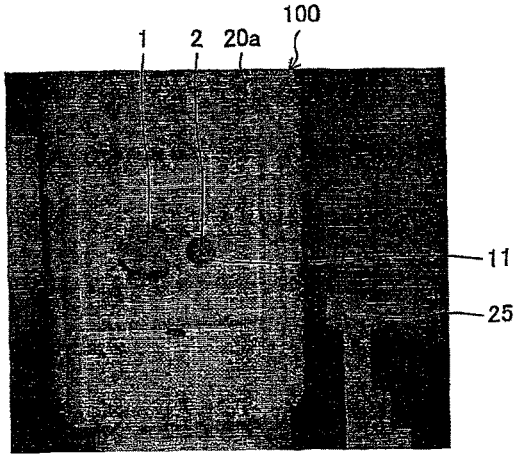

[Fig. 9]
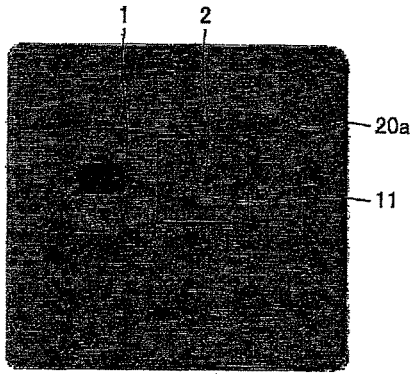
[Fig. 10]
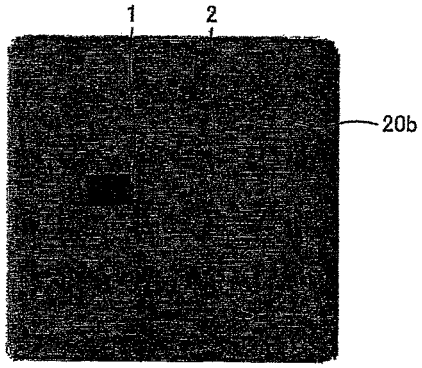
[Fig. 11]
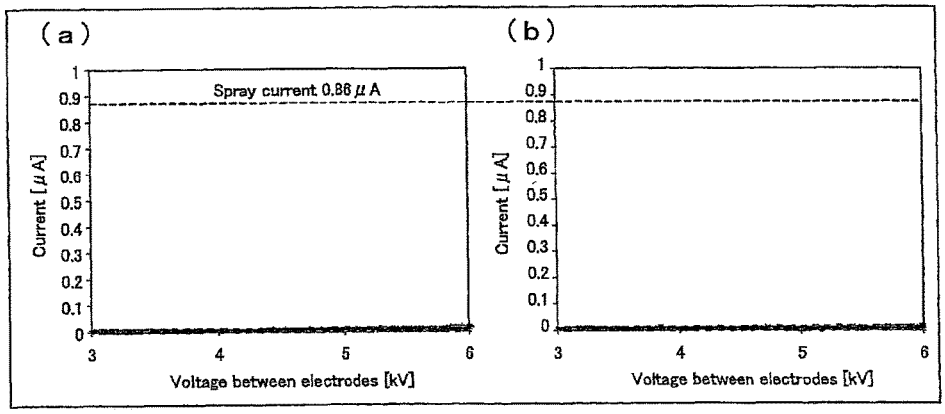

[Fig. 12]
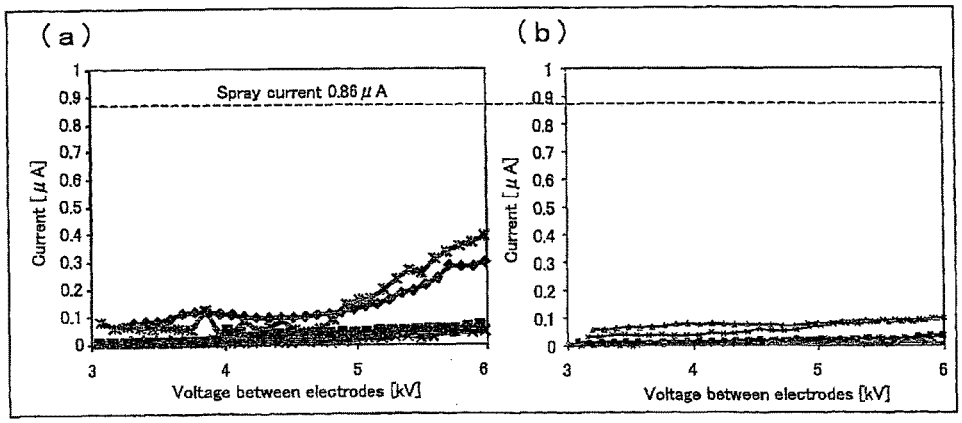
[Fig. 13]
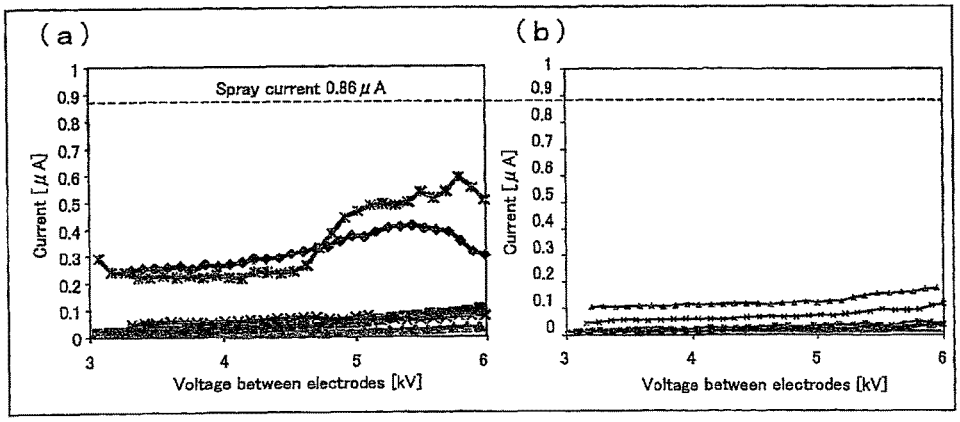
[Fig. 14]
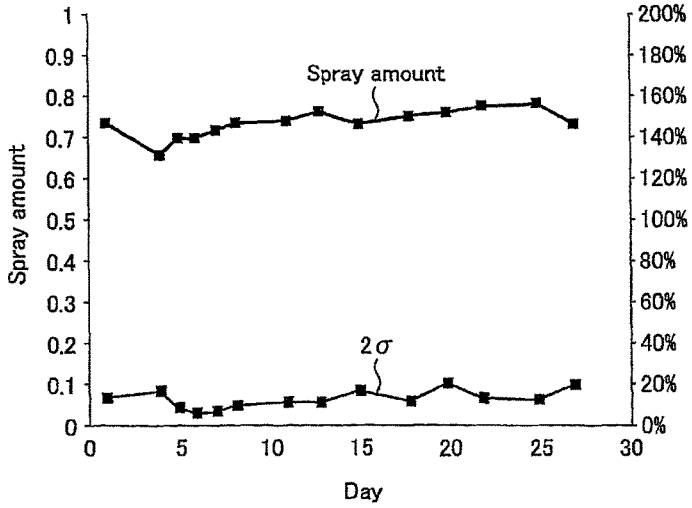

[Fig. 15]
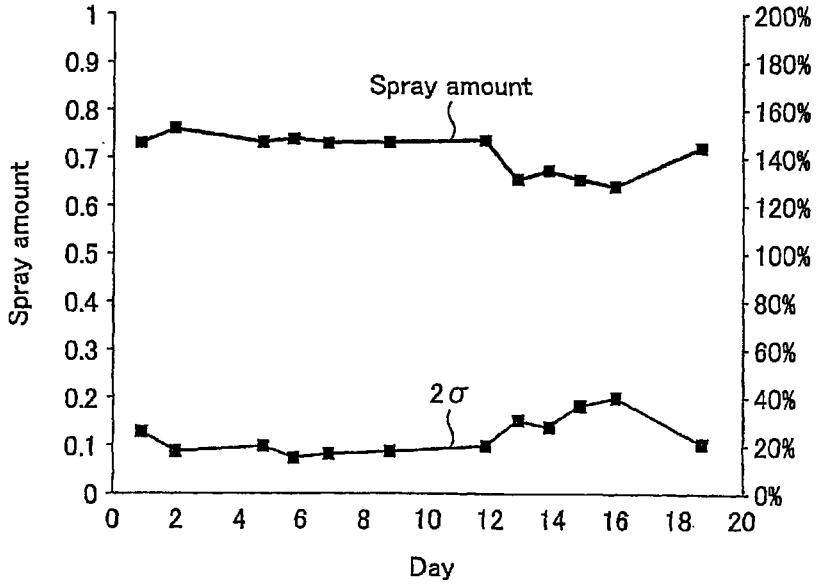
[Fig. 16]
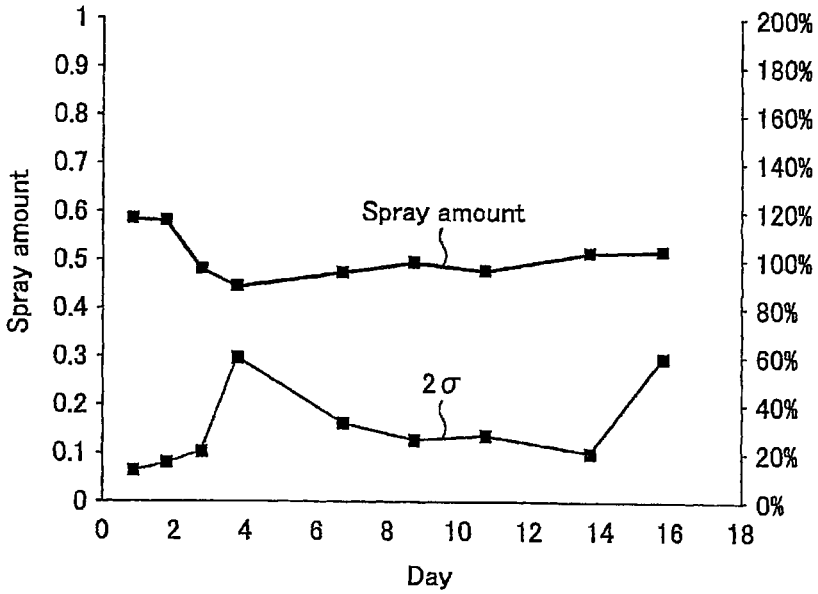

[Fig. 17]
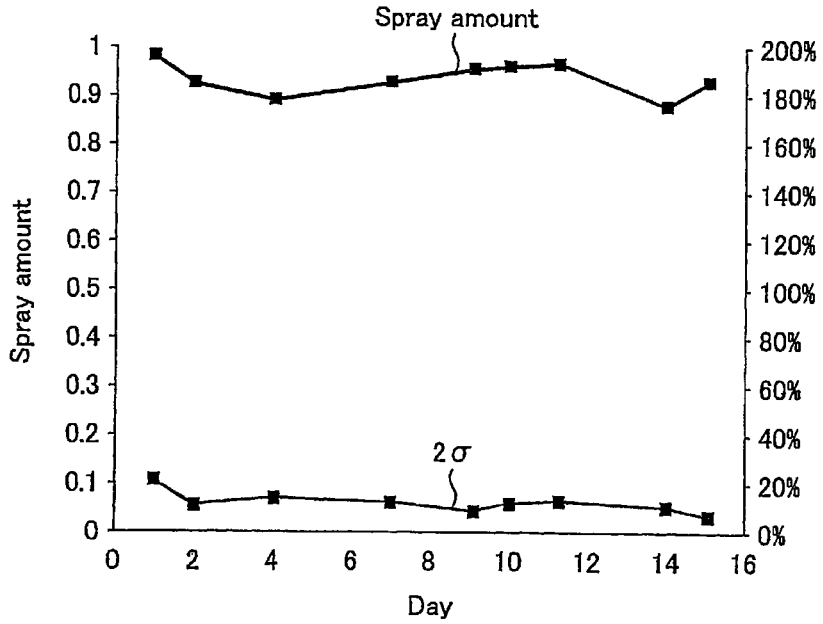
[Fig. 18]
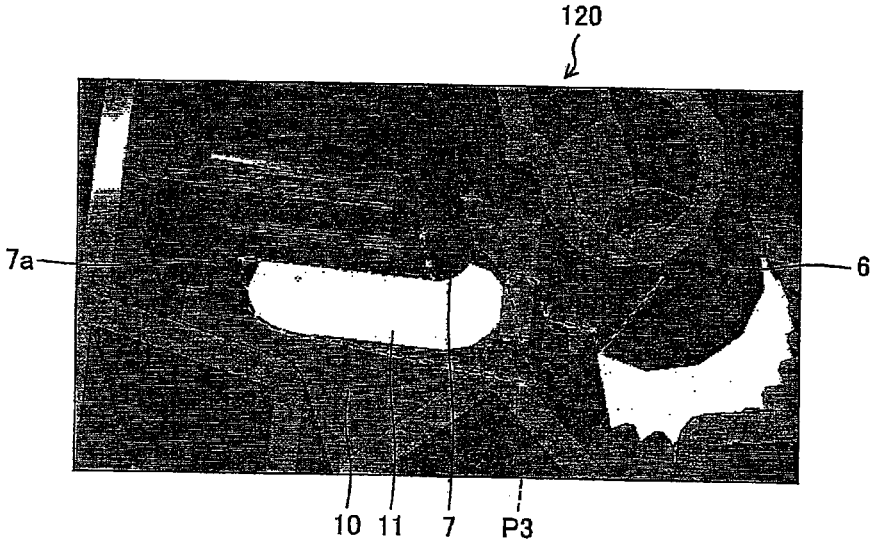

[Fig. 19]
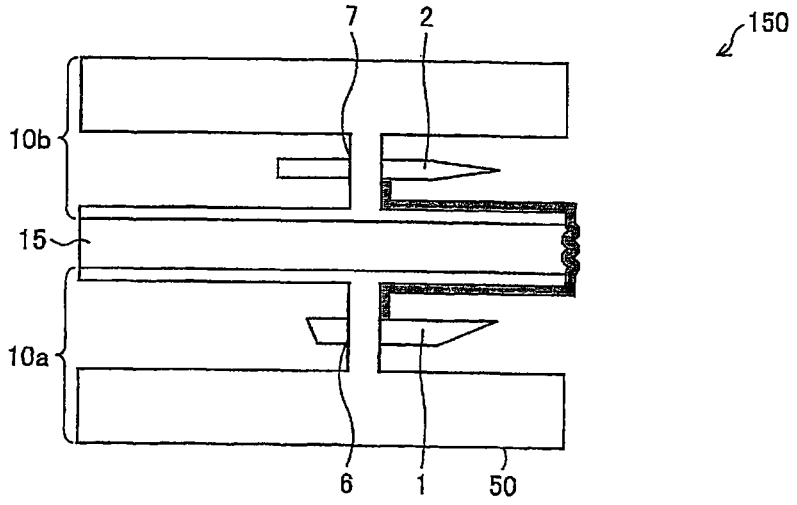
[Fig. 20]
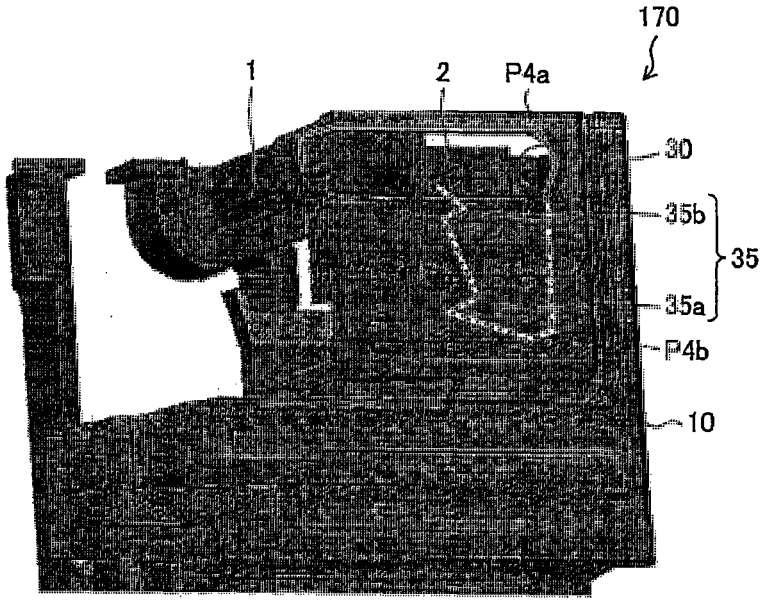

[Fig. 21]
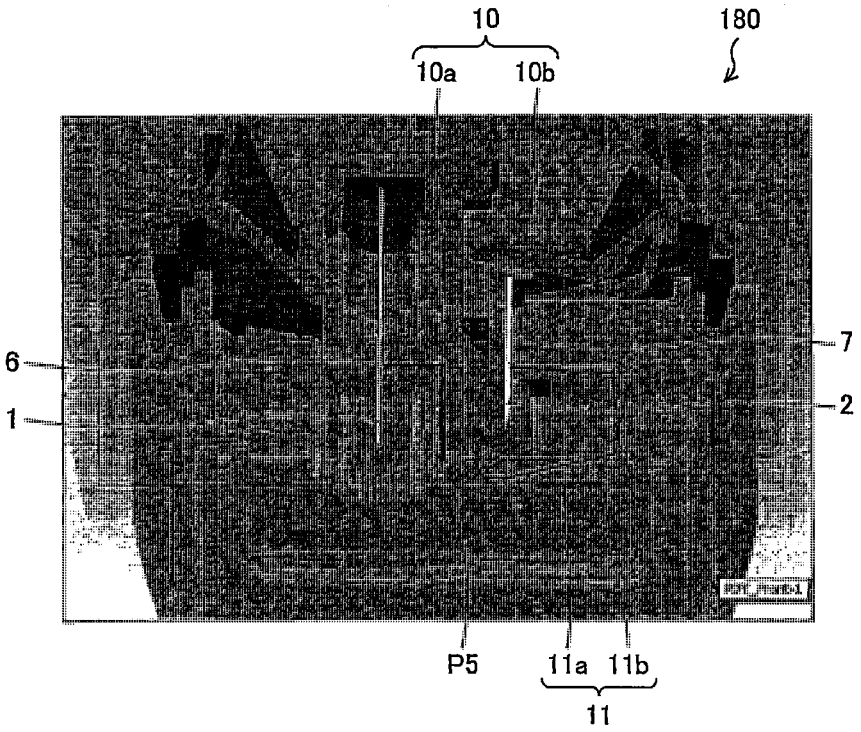

ELECTROSTATIC SPRAY DEVICE AND METHOD FOR POSITIONING FOR THE SAME

TECHNICAL FIELD

The present invention relates to an electrostatic spray device capable of reducing a leakage current, and a method for positioning for the electrostatic spray device.

BACKGROUND ART

Conventionally, spray devices which spray a liquid in a container via a nozzle have been used in a variety of fields. A known example of such spray devices is an electrostatic spray device which atomizes and sprays a liquid by EHD (Electro Hydrodynamics). The electrostatic spray device generates an electric field in the vicinity of an end of a nozzle, and atomizes and sprays a liquid at the end of the nozzle by using the electric field. Known examples of documents which disclose such electrostatic spray devices are Patent Literatures 1 and 2.

CITATION LIST

Patent Literature

[PTL 1]
Japanese Translation of PCT International Application, Tokuhyo, No. 2004-530552 A (Publication Date: Oct. 7, 2004)
[PTL 2]
Japanese Translation of PCT International Application, Tokuhyo, No. 2006-521915 A (Publication Date: Sep. 28, 2006)

SUMMARY OF INVENTION

Technical Problem

However, there is a room for improvement in the techniques of Patent Literatures 1, 2 etc. in the following regard.

The electrostatic spray device of Patent Literature 1 includes a spray electrode and a reference electrode. The spray electrode is a conduit which contains a liquid to be sprayed, and the spray electrode and the reference electrode are adjacent to a dielectric material. The spray device of Patent Literature 1 includes housing made of a dielectric material which defines concave sections where the electrodes are positioned respectively, and an electric circuit capable of generating a potential difference between the spray electrode and the reference electrode is connected with the spray electrode and the reference electrode.

In the above configuration, normally, there is generated an electric field in the air between the spray electrode and the reference electrode, thereby causing a flow of charges in the air. However, if droplets are attached between the spray electrode and the reference electrode while operating the electrostatic spray device, there is a possibility that the attached droplets electrically connect the spray electrode with the reference electrode, thereby generating a leakage current between the spray electrode and the reference electrode. There is also a possibility that the leakage current is generated due to water content etc. in the air under severe operation conditions such as high humidity, and the leakage current destabilizes the amount of a liquid sprayed from the electrostatic spray device. The same problem is applicable to the electrostatic spray device of Patent Literature 2.

The present invention was made in view of the foregoing problem. An object of the present invention is to provide an electrostatic spray device capable of reducing a leakage current, and a method for positioning for the electrostatic spray device.

Solution to Problem

In order to solve the foregoing problem, an electrostatic spray device of the present invention includes: a first electrode configured to spray a material from an end thereof; a second electrode for allowing voltage application across the first electrode and the second electrode; a dielectric on which the first electrode and the second electrode are provided; and a detour section provided on a surface of the dielectric, for providing on the surface of the dielectric a detouring current path between the first electrode and the second electrode.

In order to solve the foregoing problem, a method of the present invention is a method for providing, on a dielectric of an electrostatic spray device, a first electrode configured to spray a material from an end thereof and a second electrode for allowing voltage application across the first electrode and the second electrode, the method including the step of providing on the dielectric the first electrode and the second electrode and a detour section for providing, on a surface of the dielectric, a detouring current path between the first electrode and the second electrode.

With the arrangement, the electrostatic spray device of the present invention includes the detour section, and the method of the present invention includes providing the detour section, so that the electrostatic spray device of the present invention and the method of the present invention can realize a longer current path between the first electrode and the second electrode on the surface of the dielectric.

Consequently, the electrostatic spray device of the present invention can reduce a possibility that the first electrode and the second electrode are electrically connected with each other by droplets etc. Thus, the electrostatic spray device of the present invention can reduce generation of a leakage current and stably spray a spray liquid, improving a conventional electrostatic spray device in this regard.

The electrostatic spray device of the present invention may be arranged such that the detour section is a gap section by which the surface of the dielectric between a first electrode attaching section to which the first electrode is attached on the dielectric and a second electrode attaching section to which the second electrode is attached on the dielectric is not on a same plane cross-sectionally.

The method of the present invention may be arranged such that the detour section is a gap section by which the surface of the dielectric between a first electrode attaching section to which the first electrode is attached on the dielectric and a second electrode attaching section to which the second electrode is attached on the dielectric is not on a same plane cross-sectionally.

The detour section is a gap section, by which the surface of the dielectric between a first electrode attaching section to which the first electrode is attached on the dielectric and a second electrode attaching section to which the second electrode is attached on the dielectric is not on the same plane cross-sectionally. That is, since the surface of the dielectric is not on the same plane cross-sectionally, the current path between the first electrode and the second electrode on the surface of the dielectric can be longer.

Consequently, the electrostatic spray device of the present invention can further reduce generation of a leakage current and stably spray a spray liquid.

The electrostatic spray device of the present invention may be arranged such that the detour section is a concave or convex section between a first electrode attaching section to which the first electrode is attached on the dielectric and a second electrode attaching section to which the second electrode is attached on the dielectric.

The method of the present invention may be arranged such that the detour section is a concave or convex section between a first electrode attaching section to which the first electrode is attached on the dielectric and a second electrode attaching section to which the second electrode is attached on the dielectric.

The detour section is a concave or convex section which is provided between the first electrode attaching section to which the first electrode is attached and the second electrode attaching section to which the second electrode is attached. That is, existence of the concave or convex section allows the current path between the first electrode and the second electrode on the surface of the dielectric to be longer.

Consequently, the electrostatic spray device of the present invention can further reduce generation of a leakage current and stably spray a spray liquid.

In order to solve the foregoing problem, an electrostatic spray device of the present invention includes: a first electrode configured to spray a material from an end thereof; a second electrode for allowing voltage application across the first electrode and the second electrode; and a dielectric on which the first electrode and the second electrode are provided, a current path being provided between the first electrode and the second electrode on a surface of the dielectric, the current path having potential gradient of 1.41 kV/cm or less.

If droplets are attached to the dielectric between the first electrode and the second electrode while operating the electrostatic spray device, there is a possibility that the attached droplets electrically connect the first electrode with the second electrode, thereby generating a leakage current between the first electrode and the second electrode. There is also a possibility that the leakage current is generated due to water content etc. in the air under severe operation conditions such as high humidity, and the leakage current destabilizes the amount of a liquid sprayed from the electrostatic spray device.

In this regard, the electrostatic spray device of the present invention is designed such that the potential gradient of the current path between the first electrode and the second electrode on the surface of the dielectric is 1.41 kV/cm or less. That is, the electrostatic spray device of the present invention has a longer current path between the first electrode and the second electrode than a conventional one, thereby reducing the possibility that the first electrode and the second electrode are electrically connected with each other by droplets etc. Consequently, the electrostatic spray device of the present invention can reduce generation of a leakage current and stably spray a spray liquid, improving a conventional electrostatic spray device in this regard.

Furthermore, the electrostatic spray device of the present invention may be arranged such that the potential gradient is 0.86 kV/cm or less.

With the arrangement, the current path between the first electrode and the second electrode on the surface of the dielectric is made further longer.

Consequently, the electrostatic spray device of the present invention can further reduce generation of a leakage current and stably spray a spray liquid.

Advantageous Effects of Invention

As described above, the electrostatic spray device of the present invention includes: a first electrode configured to spray a material from an end thereof; a second electrode for allowing voltage application across the first electrode and the second electrode; a dielectric on which the first electrode and the second electrode are provided; and a detour section provided on a surface of the dielectric, for providing on the surface of the dielectric a detouring current path between the first electrode and the second electrode.

As described above, the method of the present invention includes the step of providing on the dielectric the first electrode and the second electrode and a detour section for providing, on a surface of the dielectric, a detouring current path between the first electrode and the second electrode.

As described above, an electrostatic spray device of the present invention includes: a first electrode configured to spray a material from an end thereof; a second electrode for allowing voltage application across the first electrode and the second electrode; and a dielectric on which the first electrode and the second electrode are provided, a current path being provided between the first electrode and the second electrode on a surface of the dielectric, the current path having potential gradient of 1.41 kV/cm or less.

Consequently, it is possible to provide an electrostatic spray device capable of reducing a leakage current.

BRIEF DESCRIPTION OF DRAWINGS

FIG. 1 is a view for explaining a structure of a main part of an electrostatic spray device in accordance with the present embodiment.

FIG. 2 is a view illustrating an example of a cross section in the vicinity of a gap section.

FIG. 3 is a view illustrating an example of a structure of a main part of a dielectric.

FIG. 4 is a view for explaining examples of positions where a spray electrode and a reference electrode are attached inside the electrostatic spray device in accordance with the present embodiment. FIG. 4(*a*) illustrates an internal structure of housing, and FIG. 4(*b*) illustrates an internal structure of another housing.

FIG. 5 is a view for explaining a structure of a main part of an electrostatic spray device compared with the electrostatic spray device in accordance with the present embodiment.

FIG. 6 is a view for explaining positions where a spray electrode and a reference electrode are attached inside the electrostatic spray device compared with the electrostatic spray device in accordance with the present embodiment. FIG. 6(*a*) illustrates an internal structure of housing, and FIG. 6(*b*) illustrates an internal structure of another housing.

FIG. 7 illustrates an electrostatic spray device used in a comparison test.

FIG. 8 illustrates a photograph of an electrostatic spray device after a spray electrode, a spray electrode supporting section, and housing were assembled, and the spray electrode supporting section.

FIG. 9 illustrates an enlarged photograph of a gap section 11 in an electrostatic spray device.

FIG. 10 illustrates an enlarged photograph of a spray electrode and a reference electrode in the electrostatic spray device compared with the electrostatic spray device in accordance with the present embodiment.

FIG. 11 illustrates leakage currents at temperature of degree and relative humidity of 55%. FIG. 11(*a*) illustrates the result of the test on the electrostatic spray device compared with the electrostatic spray device in accordance with the present embodiment, and FIG. 11(*b*) illustrates the result of the test on the electrostatic spray device in accordance with the present embodiment.

FIG. 12 illustrates leakage currents at temperature of 28 degree and relative humidity of 80%. FIG. 12(*a*) illustrates the result of the test on the electrostatic spray device compared with the electrostatic spray device in accordance with the present embodiment, and FIG. 12(*b*) illustrates the result of the test on the electrostatic spray device in accordance with the present embodiment.

FIG. 13 illustrates leakage currents at temperature of degree and relative humidity of 80%. FIG. 13(*a*) illustrates the result of the test on the electrostatic spray device compared with the electrostatic spray device in accordance with the present embodiment, and FIG. 13(*b*) illustrates the result of the test on the electrostatic spray device in accordance with the present embodiment.

FIG. 14 shows the results of the tests on the electrostatic spray device compared with the electrostatic spray device in accordance with the present embodiment, under test conditions that temperature was 24 degree to 25 degree and relative humidity was 45% to 70%.

FIG. 15 shows the results of the tests on the electrostatic spray device 100 in accordance with the present embodiment, under test conditions that temperature was 24 degree to 25 degree and relative humidity was 45% to 70%.

FIG. 16 shows the results of the tests on the electrostatic spray device compared with the electrostatic spray device in accordance with the present embodiment, under test conditions that temperature was 35 degree and relative humidity was 75%.

FIG. 17 shows the results of the tests on the electrostatic spray device in accordance with the present embodiment, under test conditions that temperature was 35 degree and relative humidity was 75%.

FIG. 18 is a view for explaining a structure of a main part of an electrostatic spray device which is a modification example of the present embodiment.

FIG. 19 is a view for explaining a structure of a main part of an electrostatic spray device which is a modification example of the present embodiment.

FIG. 20 is a view for explaining a structure of a main part of an electrostatic spray device which is a modification example of the present embodiment.

FIG. 21 is a view for explaining a structure of a main part of an electrostatic spray device which is a modification example of the present embodiment.

DESCRIPTION OF EMBODIMENTS

The following description will discuss an electrostatic spray device 100 etc. in accordance with an embodiment of the present invention, with reference to drawings. In the following description, the same members and the same components are given the same reference signs, and have the same names and the same functions, and accordingly detailed descriptions thereof will not be repeated.

[Structure of Main Part of Electrostatic Spray Device 100]

Initially, the following description will discuss a structure of a main part of the electrostatic spray device 100 with reference to FIG. 1. FIG. 1 is a view for explaining the structure of the main part of the electrostatic spray device 100.

The electrostatic spray device 100 is used for spraying of aromatic oils, chemical materials for agricultural products, medicines, agricultural chemicals, pesticides, air-cleaning agents etc. and for other operations, and includes at least a spray electrode (first electrode) 1, a reference electrode (second electrode) 2, a power device 3, and a dielectric 10. The electrostatic spray device 100 may be arranged such that the power device 3 is provided outside and the electrostatic spray device 100 is connected with the power device 3.

The spray electrode 1 includes a conductive conduit such as a metal capillary (e.g. type 304 stainless steel) and a spray section which is a front end of the spray electrode 1. The spray electrode 1 is connected with the reference electrode 2 via the power device 3, and sprays an atomized material from the spray section.

The reference electrode 2 is made of a conductive rod such as a metal pin (e.g. type 304 steel pin). The spray electrode 1 and the reference electrode 2 are positioned to be parallel with each other with a predetermined distance therebetween. The distance between the spray electrode 1 and the reference electrode 2 is 8 mm for example. The power device 3 applies a high voltage across the spray electrode 1 and the reference electrode 2. For example, the power source 3 applies a high voltage of 1-30 kV (e.g. 3-7 kV) across the spray electrode 1 and the reference electrode 2. Application of a high voltage generates an electric field between the electrodes, generating electrical duplexes inside the dielectric 10. At that time, the spray electrode 1 is charged positively, and the reference electrode 2 is charged negatively (or vice versa). Then, negative duplexes are generated on the surface of the dielectric 10 which surface is closest to the positively-charged spray electrode 1, and positive duplexes are generated on the surface of the dielectric 10 which surface is closest to the negatively-charged reference electrode 2, so that a charged gas and/or a charged material are discharged by the spray electrode 1 and the reference electrode 2.

The dielectric 10 is made of a dielectric material such as nylon 6, nylon 11, nylon 12, nylon 66, polypropylene, and a polyacetyl-polytetrafluoroethylene mixture. The dielectric 10 supports the spray electrode 1 at a spray electrode attaching section 6, and supports the reference electrode 2 at a reference electrode attaching section 7.

Besides, in the electrostatic spray device 100, the dielectric 10 includes a dielectric 10*a* and a dielectric 10*b*. A gap section 11 (detour section) is provided between the dielectric 10*a* and the dielectric 10*b*. The dielectric 10*a* and the dielectric 10*b* may be entirely different members, or may be separate with the gap section 11 therebetween but are integrated with each other at other part. The gap section can be expressed as a groove, a concavity, or a gap by which the surface between the spray electrode attaching section 6 and the reference electrode attaching section 7 is not on the same plane cross-sectionally in axis directions of the spray electrode 1 and the reference electrode 2.

It is desirable that conductive sections which are possibly connected with the spray electrode 1 and the reference electrode 2 are positioned to be away (hidden) from the spray electrode 1 and the reference electrode 2. This allows protecting an electric field generated between the spray electrode 1 and the reference electrode 2, so that the device can operate more stably.

P1 in FIG. 1 indicates a current path between the spray electrode 1 and the reference electrode 2 on the surface of the dielectric 10. The current path P1 will be described later with reference to FIGS. 2 and 3.

[Gap Section 11]

Next, the following description will discuss a structure of a main part of the dielectric 10 in the vicinity of the gap section 11. FIG. 2 is a view illustrating an example of a cross section in the vicinity of the gap section 11.

As illustrated in FIG. 2, the dielectric 10 includes the spray electrode attaching section 6 at the dielectric 10*a* and the reference electrode attaching section 7 at the dielectric 10*b*. Further, the dielectric 10 includes the gap section 11 between the spray electrode attaching section 6 and the reference electrode attaching section 7. A broken line in FIG. 2 indicates the current path P1 between the spray electrode 1 and the reference electrode 2 on the surface of the dielectric 10. The current path P1 will be described later in comparison to a current path P2 in FIG. 3.

FIG. 4 is a view for explaining examples of positions where the spray electrode 1 and the reference electrode 2 are attached inside the electrostatic spray device 100. FIG. 4(*a*) illustrates an internal structure of housing 20*a*, and FIG. 4(*b*) illustrates an internal structure of housing 21*a*.

The combination of the housing 20*a* and the housing 21*a* defines the outer surface of the electrostatic spray device 100. The housing 20*a* and the housing 21*a* have, on facing surfaces thereof, structures to which the spray electrode 1 and the reference electrode 2 are attached, respectively. The spray electrode 1 is attached to a portion indicated by an ellipse in FIG. 4(*a*), and the reference electrode 2 is attached to a portion indicated by an ellipse in FIG. 4(*b*). That is, the spray electrode 1 and the reference electrode 2 are attached to different housings. The gap section 11 is provided between the spray electrode 1 and the reference electrode 2.

[Structure of Main Part of Electrostatic Spray Device 200]

Next, with reference to FIG. 5, the following description will discuss a structure of a main part of an electrostatic spray device 200 compared with the electrostatic spray device 100. FIG. 5 is a view for explaining the structure of the main part of the electrostatic spray device 200.

The electrostatic spray device 200 includes at least a spray electrode 1, a reference electrode 2, a power device 3, and a dielectric 50.

The dielectric 50 is made of a dielectric material such as nylon 6, nylon 11, nylon 12, nylon 66, polypropylene, and a polyacetyl-polytetrafluoroethylene mixture. The dielectric 50 supports the spray electrode 1 at a spray electrode attaching section 60, and supports the reference electrode 2 at a reference electrode attaching section 70.

The dielectric 50 is different from the dielectric 10 in that the dielectric 50 does not have a gap section between the spray electrode 1 and the reference electrode 2. This is described below with reference to FIG. 3.

FIG. 3 is a view illustrating an example of a structure of a main part of the dielectric 50.

The dielectric 50 includes the spray electrode attaching section 60 to which the spray electrode 1 is attached and the reference electrode attaching section 70 to which the reference electrode 2 is attached. A surface between the spray electrode attaching section 60 and the reference electrode attaching section 70 is on the same plane cross-sectionally, and there is no gap section. A current path between the spray electrode 1 and the reference electrode 2 on the surface of the dielectric 10 is the current path P2 indicated by a broken line in FIG. 3.

FIG. 6 is a view for explaining positions where the spray electrode 1 and the reference electrode 2 are attached inside the electrostatic spray device 200. FIG. 6(*a*) illustrates an internal structure of housing 20*b*, and FIG. 6(*b*) illustrates an internal structure of housing 21*b*.

The combination of the housing 20*b* and the housing 21*b* defines the outer surface of the electrostatic spray device 200. The housing 20*b* has a structure to which the spray electrode 1 and the reference electrode 2 are attached. The spray electrode 1 and the reference electrode 2 are attached to a portion indicated by an ellipse in FIG. 6(*a*). A surface between the spray electrode attaching section and the reference electrode attaching section is on the same plane cross-sectionally, and there is no gap section.

FIG. 6(*b*) does not illustrate a portion of the housing 21*b* to which portion the spray electrode 1 and the reference electrode 2 are to be attached. This is because the spray electrode 1 and the reference electrode 2 are attached to the housing 20*b*.

(Current Path)

Next, the following description will discuss the effect yielded by the gap section 11 by comparing the current path P1 of the electrostatic spray device 100 with the current path P2 of the electrostatic spray device 200. The current path indicates the shortest current path between the spray electrode 1 and the reference electrode 2 on the surface of the dielectric.

Initially, with reference to FIG. 5, a description will be provided below as to a leakage current that can be generated in the electrostatic spray device 200.

An electric field is generated in the air between the spray electrode 1 and the reference electrode 2, causing a flow of charges in the air. However, if droplets are attached to the dielectric 50 between the spray electrode 1 and the reference electrode 2 while operating the electrostatic spray device 200, there is a possibility that the attached droplets electrically connect the spray electrode 1 with the reference electrode 2 via the current path P2. That is, there is a possibility that the attached droplets generate a leakage current between the spray electrode 1 and the reference electrode 2. There is also a possibility that the leakage current is generated due to water content etc. in the air under severe operation conditions such as high humidity, and the leakage current destabilizes the amount of a liquid sprayed from the electrostatic spray device 200.

In contrast, as illustrated in FIG. 1, the electrostatic spray device 100 includes the gap section 11 which divides the dielectric 10 into the dielectric 10*a* and the dielectric 10*b*. Consequently, the current path P1 between the spray electrode 1 and the reference electrode 2 in the electrostatic spray device 100 can be longer than the current path P2 in the electrostatic spray device 200, so that the electrostatic spray device 100 can reduce a leakage current and stabilize the spray amount compared to the electrostatic spray device 200.

With reference to FIG. 7 etc., the following description will more specifically discuss the effect yielded by the longer current path of the electrostatic spray device 100 based on differences in the leakage current and the spray amount between the electrostatic spray device 100 and the electrostatic spray device 200.

[Comparisons in Leakage Current and Spray Amount]

There were carried out tests for comparing the electrostatic spray device 100 with the electrostatic spray device 200 in terms of the leakage current and the spray amount. The results are as follows.

(Test Conditions)

FIG. 7 illustrates the electrostatic spray device 100 used in the comparison tests. FIG. 7(*a*) is an exploded view of the spray electrode 1, a spray electrode supporting section 25, and the housing 21*a*. FIG. 7(*b*) is an assembly view of the spray electrode 1, the spray electrode supporting section 25, and the housing 21*a*. FIG. 7(*c*) is a view for explaining a position where the reference electrode 2 is attached.

In the electrostatic spray device 100 used in the comparison tests, the spray electrode 1 was supported by the spray electrode supporting section 25 made of plastic, and the spray electrode supporting section 25 was attached to the housing 21*a* (FIG. 7(*b*)). The reference electrode 2 was attached to the housing 20*a* (FIG. 7(*c*)). In the electrostatic spray device 100, the gap section 11 (not illustrated) was provided between the spray electrode 1 and the reference electrode 2 on the surface of the dielectric 10, so as to extend a current path between the spray electrode 1 and the reference electrode 2.

FIG. 8 illustrates a photograph of the electrostatic spray device 100 after the spray electrode 1, the spray electrode supporting section 25 and the housing 20*a* were assembled, and the spray electrode supporting section 25. As illustrated in FIG. 8, the gap section 11 was provided between the spray electrode 1 and the reference electrode 2 after the assembly of the electrostatic spray device 100.

FIG. 9 illustrates an enlarged photograph of the gap section 11 in the electrostatic spray device 100. As illustrated in FIG. 9, the gap section 11 was provided between the spray electrode 1 and the reference electrode 2. The gap section 11 allowed the current path between the spray electrode 1 and the reference electrode 2 to be extended.

On the other hand, FIG. 10 illustrates an enlarged photograph of the spray electrode 1 and the reference electrode 2 in the electrostatic spray device 200. The electrostatic spray device 200 did not have the gap section 11, so that the electrostatic spray device 200 had a shorter current path between the spray electrode 1 and the reference electrode 2 than the electrostatic spray device 100.

The following description will more specifically discuss the electrostatic spray device 100 and the electrostatic spray device 200 used in the comparison tests.

In the electrostatic spray device 100 used in the tests, the length of the current path between the spray electrode 1 and the reference electrode 2 on the surface of the dielectric 10 was 6 cm. A voltage applied across the spray electrode 1 and the reference electrode 2 was 5.2 kV at 6 G OHM. Therefore, potential gradient of the current path was 0.86 kV/cm.

In contrast, in the electrostatic spray device 200, the length of the current path between the spray electrode 1 and the reference electrode 2 was 2 cm. A voltage applied across the spray electrode 1 and the reference electrode 2 was 5.2 kV at 6 G OHM. Therefore, potential gradient of the current path was 2.6 kV/cm.

Under these conditions, temperature and humidity were changed, and the leakage currents of the electrostatic spray device 100 and the electrostatic spray device 200 were measured at various temperatures and humidities.

A supplied current was 0.86 micro ampere. The power device 3 was a charging type in order to prevent a change in voltage thereby to provide uniform test conditions. Furthermore, lest an unexpected disorder should change stored data, data of the leakage current was stored in a memory in the power device.

The following description will discuss the results of the tests of the leakage current with reference to FIG. 11 etc.

(Results of Tests of Leakage Current)

FIG. 11 illustrates leakage currents at temperature of degree and relative humidity of 55%. FIG. 11(*a*) illustrates the result of the test on the electrostatic spray device 200, and FIG. 11(*b*) illustrates the result of the test on the electrostatic spray device 100. The lateral axis indicates a voltage between electrodes, and the longitudinal axis indicates a leakage current. The number of the tests was five for each of the electrostatic spray device 100 and the electrostatic spray device 200. The same is true for FIGS. 12 and 13 mentioned later.

As illustrated in FIG. 11, under the conditions that the temperature was 25 degree and the relative humidity was 55%, a leakage current was hardly observed both in the electrostatic spray device 100 and the electrostatic spray device 200. This is also because the conditions that the temperature was 25 degree and the relative humidity was 55% were not so severe conditions and moisture content in the air was small, so that the leakage current was less likely to be generated.

FIG. 12 illustrates leakage currents at temperature of 28 degree and relative humidity of 80%. FIG. 12(*a*) illustrates the result of the test on the electrostatic spray device 200, and FIG. 12(*b*) illustrates the result of the test on the electrostatic spray device 100.

As illustrated in FIG. 12(*b*), under the conditions that the temperature was 28 degree and the relative humidity was 80%, a leakage current was observed also in the electrostatic spray device 100. However, in the electrostatic spray device 100, the results of the five tests showed similar values, and no result was notably worse than other results.

In contrast, in the electrostatic spray device 200, a large leakage current was observed particularly in two tests. That is, the electrostatic spray device 200 exhibited high frequency (rate) in generation of a leakage current, and lacked stability as a device in terms of generation of the leakage current.

FIG. 13 illustrates leakage currents at temperature of 35 degree and relative humidity of 80%. FIG. 13(*a*) illustrates the result of the test on the electrostatic spray device 200, and FIG. 13(*b*) illustrates the result of the test on the electrostatic spray device 100.

As illustrated in FIG. 13(*b*), under the conditions that the temperature was 35 degree and the relative humidity was 80%, a leakage current was observed also in the electrostatic spray device 100. However, in the electrostatic spray device 100, the results of the five tests showed similar values, and no result was notably worse than other results.

In contrast, in the electrostatic spray device 200, a large leakage current was observed particularly in two tests. That is, the electrostatic spray device 200 exhibited high frequency (rate) in generation of a leakage current, and lacked stability as a device in terms of generation of the leakage current.

In the electrostatic spray device 200, the maximum leakage current was 0.4 micro ampere under the conditions that the temperature was 28 degree and the relative humidity was 80%, which correspond to FIG. 12, and the maximum leakage current was 0.6 micro ampere under the conditions that the temperature was 35 degree and the relative humidity was 80%, which correspond to FIG. 13. This is because the test conditions corresponding to FIG. 13 are severer than the test conditions corresponding to FIG. 12 in that the conditions corresponding to FIG. 13 resulted in larger moisture content in the air due to higher temperature with respect to the same relative humidity.

In contrast, in the electrostatic spray device. 100, the maximum leakage current was 0.1 micro ampere under the conditions that the temperature was 28 degree and the relative humidity was 80%, which correspond to FIG. 12, and the maximum leakage current was 0.18 micro ampere under the conditions that the temperature was 35 degree and the relative humidity was 80%, which correspond to FIG. 13. These results show that the electrostatic spray device 100 is superior to the electrostatic spray device 200 in terms of reduction in a leakage current, and that even when the test conditions are changed, the electrostatic spray device 100 is less likely to generate a leakage current than the electrostatic spray device 200. This seems to be because the electrostatic spray device 100 had a longer current path between the spray electrode 1 and the reference electrode 2 than the electrostatic spray device 200, in other words, the electrostatic spray device 100 had gentler potential gradient than the electrostatic spray device 200.

In the electrostatic spray device, a current between the spray electrode and the reference electrode is very important feedback information for realizing a stable spray. When the current between the spray electrode and the reference electrode is only a spray current, it is possible to realize an exact and stable operation of the device. Therefore, when no current other than the spray current, e.g. no leakage current, is generated on the surface of a dielectric between the electrodes, spray performance is improved. Furthermore, since the spray performance is influenced by the size of a leakage current, reducing the leakage current as small as possible allows further improving the spray performance of the electrostatic spray device. Also in this regard, the electrostatic spray device 100 is a device further improved from the electrostatic spray device 200.

(Comparison Test in Spray Amount)

Next, with reference to FIG. 14 etc., the following description will discuss the result of comparison test in the spray amount between the electrostatic spray device 100 and the electrostatic spray device 200.

(Test Conditions)

As described above, in the electrostatic spray device 100 used in the comparison tests, the length of the current path between the spray electrode 1 and the reference electrode 2 on the surface of the dielectric was 6 cm. A voltage applied across the spray electrode 1 and the reference electrode 2 was 5.2 kV at 6 G OHM. Therefore, potential gradient of the current path was 0.86 kV/cm.

In contrast, in the electrostatic spray device 200 used in the comparison tests, the length of the current path between the spray electrode 1 and the reference electrode 2 was 2 cm. A voltage applied across the spray electrode 1 and the reference electrode 2 was 5.2 kV at 6 G OHM. Therefore, potential gradient of the current path was 2.6 kV/cm.

A spray liquid to be sprayed from the electrostatic spray device 100 and the electrostatic spray device 200 was a mixture of 30% of a fragrant material, 63% of glycol ether, and 2% of paraffin. In order to adjust conductivity, water and conductive salt were added in a weight ratio of 0.001/1.000 (w/w). The spray liquid exhibited the conductivity of 160 microS/m, a surface tension of 29.1 mN/m, and viscosity of 4.82 mPas at temperature of 25 degree. Using the spray liquid, spray amount tests were carried out five times for each of the electrostatic spray device 100 and the electrostatic spray device 200.

The conductivity was measured by F-55 (manufactured by Horiba, Ltd.) and the viscosity was measured by RB85-L (manufactured by TOKI SANGYO CO., LTD.). The surface tension was measured by DM-50 (manufactured by Kyowa Interface Science Co., Ltd.) according to a pendant-drop method based on Young-Laplace's formula.

Furthermore, in order to reproduce actual use conditions, a power device was operated with a spray duty cycle of 12.5% at 20 degree. The tests were carried out in a model room with ventilating equipment under conditions that temperature was 35 degree and relative humidity was 75%. The tests were carried out for at least 2 weeks.

The spray amount and standard deviation shown in FIG. 14 etc. mentioned later were calculated according to formulae below. Formula (1) indicates the spray amount at i-th device.

[Math. 1]

Formula (2) indicates the average of the spray amount.

[Math. 2]

In Formula (3), sigma indicates standard deviation, and sigma 2 indicates variance.

[Math. 3]

Formula (4) indicates a double of the standard deviation (2 sigma).

[Math. 4]

(Results of Spray Amount Tests)

With reference to FIG. 14 etc., the following shows the results of comparison tests on the spray amounts of the electrostatic spray device 100 and the electrostatic spray device 200. In FIG. 14 etc., the lateral axis indicates time (day), and the longitudinal axis indicates the spray amount (left) and dispersion (2sigma) (right). Dispersion was calculated with respect to each measurement interval. The same is true for FIG. 15 etc. mentioned later.

FIG. 14 shows the result of the test on the electrostatic spray device 200 under test conditions that temperature was 24 degree to 25 degree and relative humidity was 45% to 70%. In the test, the average spray amount was 0.73 g/day and 2 sigma was 8%.

FIG. 15 shows the result of the test on the electrostatic spray device 100 under test conditions that temperature was 24 degree to 25 degree and relative humidity was 45% to 70%. In the test, the average spray amount was 0.7 g/day and 2 sigma was 17.9%. Under these conditions, no great difference in spray amount was observed between the electrostatic spray device 100 and the electrostatic spray device 200. Furthermore, under these conditions, fallout or wetness of the surface was not observed at the spray electrode 1, the reference electrode 2 etc.

FIG. 16 shows the result of the test on the electrostatic spray device 200 under test conditions that temperature was 35 degree and relative humidity was 75%. In the test, the average spray amount was 0.51 g/day and 2 sigma was 26%. Dispersion in the measurement period greatly increased from 12.9% to 59.4%.

FIG. 17 shows the result of the test on the electrostatic spray device 100 under test conditions that temperature was 35 degree and relative humidity was 75%. In the test, the average spray amount was 0.93 g/day and 2 sigma was 6%.

Under the test conditions that temperature was 35 degree and relative humidity was 75%, the average spray amount of the electrostatic spray device 100 was 0.93 g/day whereas the average spray amount of the electrostatic spray device 200 was 0.51 g/day, which shows a great difference in spray amount between the electrostatic spray device 100 and the electrostatic spray device 200. This clearly shows that the electrostatic spray device 100 is superior to the electrostatic spray device 200 in terms of the spray amount of the spray liquid. Thus, the effect of extending the current path between the spray electrode 1 and the reference electrode 2, in other words, making potential gradient of the current path gentler, was demonstrated.

As the temperature and the humidity are higher, the moisture content in the air is more likely to generate a leakage current and thus lead to unstableness in the spray amount. However, since the electrostatic spray device 100 is designed to have an extended current path between the spray electrode 1 and the reference electrode 2, the electrostatic spray device 100 can stably spray a constant amount of a spray liquid for two weeks or more under a highly humid condition that the relative humidity is 75%.

Comparison of FIG. 15 with FIG. 17 shows that the electrostatic spray device 100 sprays a more amount of the spray liquid under the test conditions that temperature was 35 degree and relative humidity was 75% than under the test conditions that temperature was 24 degree to 25 degree and relative humidity was 45% to 70%. This is because as the temperature is higher, the viscosity of the spray liquid is lower, resulting in a larger spray amount.

[Electrostatic Spray Device 120]

With reference to FIG. 18, the following description will discuss an electrostatic spray device 120 which is a modification example of the electrostatic spray device 100. FIG. 18 is a view for explaining a structure of a main part of the electrostatic spray device 120. Descriptions which are the same as those made with reference to FIG. 1 etc. are omitted here.

The electrostatic spray device 120 includes at least a spray electrode, a reference electrode, and a dielectric 10. The spray electrode is attached to a spray electrode attaching section 6, and the reference electrode is attached to a reference electrode attaching section 7. The dielectric 10 includes a gap section 11.

To be more specific, the reference electrode attaching section 7 includes a reference electrode attaching section 7*a*. The reference electrode attaching section 7*a* extends in a direction opposite to the spray electrode attaching section 6 so as to be jointed with the dielectric 10. This provides the gap section 11 between the spray electrode attaching section 6 and the reference electrode attaching section 7, so that a current path P3 (broken line in FIG. 18) between the spray electrode 1 and the reference electrode 2 on the surface of the dielectric 10 is longer than the current path P2 in the electrostatic spray device 200.

The inventors of the present invention actually manufactured the electrostatic spray device 120 and confirmed that potential gradient of the current path P3 was 1.41 kV/cm. Furthermore, the inventors of the present invention confirmed that existence of the gap section 11 allowed the electrostatic spray device 120 to reduce a leakage current and stably spray a spray liquid under severe conditions. Thus, the electrostatic spray device 120 can provide a user with a device further improved from the electrostatic spray device 200.

A description was provided above as to manufacture of the electrostatic spray device 120 with the potential gradient of the current path being 1.41 kV/cm. However, the potential gradient can be less than 1.41 kV/cm if possible in consideration of layout etc. of the device. Furthermore, in consideration that the lower potential gradient yields a better effect, by setting the potential gradient to be lower than the potential gradient of the electrostatic spray device 200 being 2.6 kV/cm, the electrostatic spray device of the present embodiment can reduce a leakage current and stably spray a spray liquid under severe conditions.

[Electrostatic Spray Device 150]

With reference to FIG. 19, the following description will discuss an electrostatic spray device 150 which is a modification example of the electrostatic spray device 100. FIG. 19 is a view for explaining a structure of a main part of the electrostatic spray device 150. Descriptions which are the same as those made with reference to FIG. 1 etc. are omitted here.

The electrostatic spray device 150 includes at least a spray electrode 1, a reference electrode 2, and a dielectric 10. The dielectric 10 is divided into a dielectric 10*a* and a dielectric 10*b*. A dielectric 15 (detour section) is provided between the dielectric 10*a* and the dielectric 10*b*.

The dielectric 15 may be made of the same material as the dielectric 10. However, the dielectric 15 has a concave or convex section, which extends a current path between the spray electrode 1 and the reference electrode 2 on the surface of the dielectric 10. This allows the electrostatic spray device 150 to reduce a leakage current between the spray electrode 1 and the reference electrode 2 and stably spray a spray liquid under severe conditions. Thus, the electrostatic spray device 150 can provide a user with a device further improved from the electrostatic spray device 200.

[Electrostatic Spray Device 170]

With reference to FIG. 20, the following description will discuss an electrostatic spray device 170 which is a modification example of the electrostatic spray device 100. FIG. 20 is a view for explaining a structure of a main part of the electrostatic spray device 170. Descriptions which are the same as those made with reference to FIG. 1 etc. are omitted here.

The electrostatic spray device 170 includes at least a spray electrode 1, a reference electrode 2, and a dielectric 10. The dielectric 10 has an opening 30 so as to expose the reference electrode 2 to the outside. The dielectric 10 includes a bump section (concave or convex section) 35*a* and a bump section (concave or convex section) 35*b* each of which stands in an axis direction of the reference electrode 2 in order to attach the reference electrode 2 to the dielectric 10.

P4 in FIG. 20 indicates a current path between the spray electrode 1 and the reference electrode 2 on the surface of the dielectric 10. In P4, P4*a* indicates a current path on the outer surface of the electrostatic spray device 170. P4*b* indicates a current path on the inner surface of the electrostatic spray device 170.

To be more specific, P4*a* is a current path whose starting point (or end point) is the spray electrode 1 and which goes through an end face of an orifice of the opening 30. P4*b* is a current path which starts from the end face of the orifice of the opening 30, goes through the surface of the dielectric 10 inside the electrostatic spray device 170 and through the bump section 35*a* and the bump section 35*b*, and arrives at the reference electrode 2. That is, the current path P4 between the spray electrode 1 and the reference electrode 2 goes through the outer surface and the inner surface of the dielectric 10 which defines the surface of the device, and goes through the bump section 35*a* and the bump section 35*b*, so that the current path between the spray electrode 1 and the reference electrode 2 is made longer.

This allows the electrostatic spray device 170 to reduce a leakage current between the spray electrode 1 and the reference electrode 2 and stably spray a spray liquid under severe conditions. Thus, the electrostatic spray device 170 can provide a user with a device further improved from the electrostatic spray device 200.

In FIG. 20, there are two bump sections (bump sections 35*a* and 35*b*). However, the number of the bump section is not limited to two, and may be one or not less than three. The bump section is not necessarily to be positioned as illustrated in FIG. 20, and may be positioned otherwise.

A configuration for extending a current path between the spray electrode 1 and the reference electrode 2 is not limited to that illustrated in FIG. 20. The configuration for extending a current path between the spray electrode 1 and the reference electrode 2, i.e. a configuration for forming the detour section, is not limited to the illustrated configuration and may be different provided that the configuration is in accordance with a technical idea of extending the current path.

[Electrostatic Spray Device 180]

With reference to FIG. 21, the following description will discuss an electrostatic spray device 180 which is a modification example of the electrostatic spray device 100. FIG. 21 is a view for explaining a structure of a main part of the electrostatic spray device 180. Descriptions which are the same as those made with reference to FIG. 1 etc. are omitted here.

The electrostatic spray device 180 includes at least a spray electrode 1, a reference electrode 2, and a dielectric 10. In FIG. 21, the dielectric 10 is integrally formed. For convenience, the dielectric 10 is described while being divided into the dielectric 10*a* and the dielectric 10*b*. In the electrostatic spray device 180, a gap section 11 (detour section) is provided (positioned) between the dielectric 10*a* and the dielectric 10*b*. The dielectric 10*a* and the dielectric 10*b* may be entirely different members, or may be separate with the gap section 11 therebetween but are integrated with each other at other part. The gap section 11 can be realized as a groove, a concavity, or a gap by which the surface between the spray electrode attaching section 6 and the reference electrode attaching section 7 is not on the same plane cross-sectionally.

P5 in FIG. 21 indicates a current path between the spray electrode 1 and the reference electrode 2 on the surface of the dielectric 10.

To be more specific, P5 is a current path whose starting point (or end point) is the spray electrode 1 and which goes through the surface of the dielectric 10*a*. Since the gap section 11 made of a concavity 11*a* and a groove 11*b* is provided between the dielectric 10*a* and the dielectric 10*b* and P5 goes along verges of the concavity 11*a* and the groove 11*b*, a current path between the spray electrode 1 and the reference electrode 2 can be longer.

This allows the electrostatic spray device 180 to reduce a leakage current between the spray electrode 1 and the reference electrode 2 and stably spray a spray liquid under severe conditions. Thus, the electrostatic spray device 180 can provide a user with a device further improved from the electrostatic spray device 200.

Descriptions were provided above as to various modes of the electrostatic spray device in accordance with the present embodiment. These modes are examples of the present embodiment and may be combined with each other.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention relates to an electrostatic spray device capable of reducing a leakage current, and a method for positioning for the electrostatic spray device.

REFERENCE SIGNS LIST

1 Spray electrode (first electrode)
2 Reference electrode (second electrode)
3 Power device
6 Spray electrode attaching section
7 Reference electrode attaching section
7*a* Reference electrode attaching section
10 Dielectric
11 Gap section (detour section)
15 Dielectric (detour section)
25 Spray electrode supporting section
30 Opening
35*a*, 35*b* Bump section
100, 120, 150, 170, 180 Electrostatic spray device

The invention claimed is:

1. An electrostatic spray device, comprising:

a first electrode configured to spray a material from an end thereof;

a second electrode for allowing voltage application across the first electrode and the second electrode;

a dielectric comprising a first portion having a first electrode attaching section on which the first electrode is attached and a second portion having a second electrode attaching section on which the second electrode is attached; and the dielectric includes a detour section provided between a surface of the first portion of the dielectric and a surface of the second portion of the dielectric, for providing a detouring current path between the first electrode and the second electrode, wherein the surface of the first portion and the surface of the second portion are opposing surfaces and not on the same plane cross-sectionally, and are provided between the first electrode attaching section and the second electrode attaching section, and wherein the detour section is a gap defined in between the opposing surfaces.

2. The electrostatic spray device as set forth in claim 1, wherein the detouring current path does not include a direct current path between the first electrode and the second electrode.

* * * * *